United States Patent [19]

Smith

[11] Patent Number: 4,917,617

[45] Date of Patent: Apr. 17, 1990

[54] WEATHERPROOFING APPARATUS FOR TELEPHONE CONNECTORS

[75] Inventor: Thomas J. Smith, Bay Shore, N.Y.

[73] Assignee: TII Industries, Inc., Copiague

[21] Appl. No.: 375,132

[22] Filed: Jul. 3, 1989

[51] Int. Cl.[4] ..... H01R 13/44

[52] U.S. Cl. ..... 439/135; 439/278; 439/587

[58] Field of Search ..... 439/135, 271, 272, 273, 439/274, 275, 278, 279, 528, 535, 586, 587, 588, 592, 718, 738, 750; 379/332

[56] References Cited

U.S. PATENT DOCUMENTS

| | | | |
|---|---|---|---|
| D. 190,425 | 5/1961 | Dean | D26/1 |
| 4,500,158 | 2/1985 | Dola | 439/535 |
| 4,576,428 | 3/1986 | DeLuca et al. | 439/271 |
| 4,588,238 | 5/1986 | Mickelson et al. | 439/345 |
| 4,616,897 | 10/1986 | Dola | 439/535 |
| 4,681,383 | 7/1987 | Hung et al. | 439/135 |

*Primary Examiner*—Neil Abrams
*Assistant Examiner*—Khiem Nguyen
*Attorney, Agent, or Firm*—Sachs & Sachs

[57] ABSTRACT

A flexible boot adapted to receive a telphone cable plug includes an opening through which a telephone retaining lever projects. The boot receives the telephone cable through an opening provided therein and slips over the telephone plug. Upon insertion of the plug into a mating telephone jack, the boot frictionally engages the jack circumference and seals the connections from the environment. A similar boot may be utilized to protect and seal a telephone jack.

7 Claims, 1 Drawing Sheet

WEATHERPROOFING APPARATUS FOR TELEPHONE CONNECTORS

BACKGROUND OF THE INVENTION

1. Field of the Invention

The present invention relates to telephone connectors and more specifically, to a means for weatherproofing these connectors to make them impervious to the environment.

2. Discussion of the Relevant Art

Numerous attempts have been made over the years to weatherproof the conventional telephone connector generally referred to as an RJ 11C connector (modular plug) or an RJ 11C (modular jack) which is a mating connector for the modular plug. The metal contacts on the modular plug make continuous electrical contact with the electrical contacts occurring in the jack so that when a plug is inserted into the jack a continuous electrically conducting path is accomplished. This type of plug and jack connector which has become a standard in the telephone industry is generally vulnerable to moisture deposits which may short the metal terminals or may be subjected to degradation by fungus, insects and the like when exposed to the environment. Many approaches have attempted to seal the connector and protect it from being exposed to the environment.

One of the approaches is disclosed in U.S. Design Pat. No. 190,425 issued to G. W. Dean on May 30, 1961. The apparatus disclosed therein discloses a separate housing for the plug and a separate housing for the jack, which are held in position by protrusions provided on the side of the plug housing member which is received into the channels provided on the socket protecting housing member. However, if this type of protective housing was mounted in the horizontal or vertical plane access to moisture is not prevented because there is a continuous path around the circumference of the plug which permits water to enter and therefore accumulate over time.

Another approach to the problem is disclosed in U.S. Pat. No. 4,588,238 which was issued to Mickelson, et al on May 13, 1986. The apparatus disclosed therein utilizes a pressure mechanism (spring) to hold the plug element into the cooperating female or socket utilizing a resilient sealing member upon which the spring member provides pressure. Hereagain, the surface of the socket is in the same plane with the surface of the housing and thus, water may enter the connector along the seam line of the resilient member and the socket.

A more conventional and obvious solution to the problem is disclosed in U.S. Pat. No. 4,500,158 and U.S. Pat. No. 4,616,897 issued to Dola on Feb. 19, 1985 and Oct. 14, 1986, respectively. The apparatus disclosed in these patents provide for a separate cover member which is held on to the housing that receives the female socket by means of channels or grooves that receive the cover member. This approach also suffers from the same problem wherein there is a flat surface between the socket mounting and the mating plug so that any moisture entering along the channel or interface surface is accessible to the socket and thus over time can cause serious problems.

Another approach was disclosed in U.S. Pat. No. 4,576,428 issued to DeLuca, et al on May 18, 1986 which utilizes a resilient member and clamping means to surround the male plug once it is received into the female socket. However, as noted earlier, the surface of the female socket is in the same plane as the receiving member for the socket and thus, it relies on the resilient pressure and forces applied around the male plug to stop any moisture from entering. As is well known, the pressure contact is not a good protector for moisture, since by virtue of capillary action the moisture may very well follow the common surface even though under pressure, which is designed to reduce the amount of moisture entering. The approaches utilized in the known apparatuses all suffer from the same serious shortcoming which is overcome by the instant invention.

Therefore, it is an object of the present invention to provide a resilient boot or shroud adapted to cover the female socket receptacle so that a flat surface interface does not occur between the protective boot and the mounting surface of the female connector.

It is another object of the present invention to provide a simple protection for the plug and jack of a conventional telephone connection so that they are impervious to the atmospheric conditions.

It is still yet another object of the present invention to provide an inexpensive means of increasing the reliability of a telephone jack and plug arrangement which permits the removal of the plug member with ease.

It is still yet another object of the present invention to provide an inexpensive shroud or boot which will prevent the plug member from being exposed to the atmosphere and protect the female or jack member from being exposed to the atmosphere and may be mounted in the horizontal or vertical plane.

The foregoing and other objects and advantages will appear from the description to follow. In the description reference is made to the accompanying drawing which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

The present invention overcomes the shortcomings of the prior art by providing a weatherproof apparatus for a telephone connector plug having a locking lever disposed thereon and a mating telephone jack, according to the principles of the present invention comprises in combination; a resilient plug shroud which has a first opening adapted to receive a telephone cable therethrough, a second opening adapted to receive the locking lever, a third opening distal to the first opening adapted to receive the telephone plug therethrough, lip means disposed about the perimeter of the third opening which is adapted to frictionally receive a mating telephone jack, and a resilient jack shroud which has a fourth opening adapted to receive a telephone cable therethrough, a fifth opening adapted to receive a telephone jack therein and lip means disposed about the fifth opening for frictionally engaging the circumference of the telephone jack.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENTS

Figure 1:
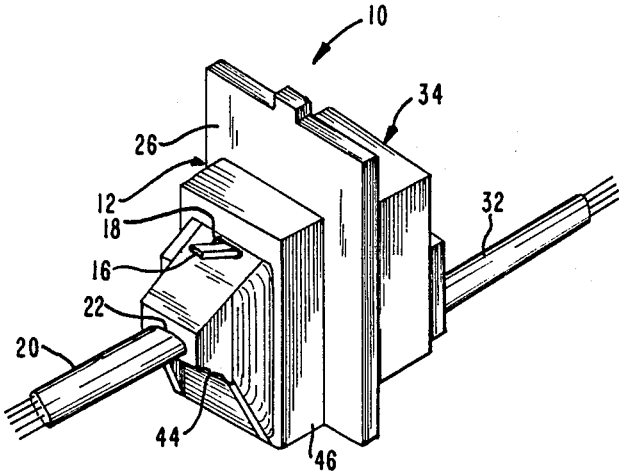
FIG. 1 is a pictorial representation of the weatherproofing apparatus, according to the principles of the present invention.

Referring now to the Figures, and in particular, to FIG. 1, there is shown a weatherproof apparatus 10 which includes a male boot or shroud 12 which has disposed therein a male telephone plug 14 (see FIG. 2) that includes the locking or retaining lever 16 that extends through an aperture 18 provided in the shroud 12. The telephone plug 14 has affixed therein, in a conventional manner a telephone cable 20 which extends through an aperture 22 provided in the boot 12. The telephone socket or jack 24 (see FIG. 2) is preferably manufactured as an integral part of mounting surface 26, in a conventional manner with a lip portion 28 extending upwardly from the surface 26. Jack 24 is of the conventional type and is adapted to receive plug 14 therein and, as is well known in the art, locking lever 16 retains the plug within the opening 30 of the jack 24 in a conventional manner. Depressing lever 16 on plug 14 together with an outward motion would permit the plug 14 to be removed from the socket 24.

The rear portion of jack 24 is provided with a set of electrical conductors to which telephone cable 32 is connected, in a conventional manner.

Figure 4:
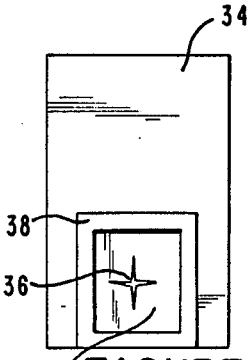
FIG. 4 is a rear view of the resilient jack shroud.

A resilient jack shroud 34 is adapted to frictionally receive the jack 24 and provide a weather tight connection. The telephone cable 32 is inserted in the opening or aperture 36 provided in the socket shroud 34. A rear view of shroud 34 is shown in FIG. 4 and includes a raised protruding portion 38 which surrounds aperture 36 and is ideally suited for receiving a suitable encapsulant 40 to seal it to the shroud 34 so that no moisture could enter through the opening 36.

Figure 2:
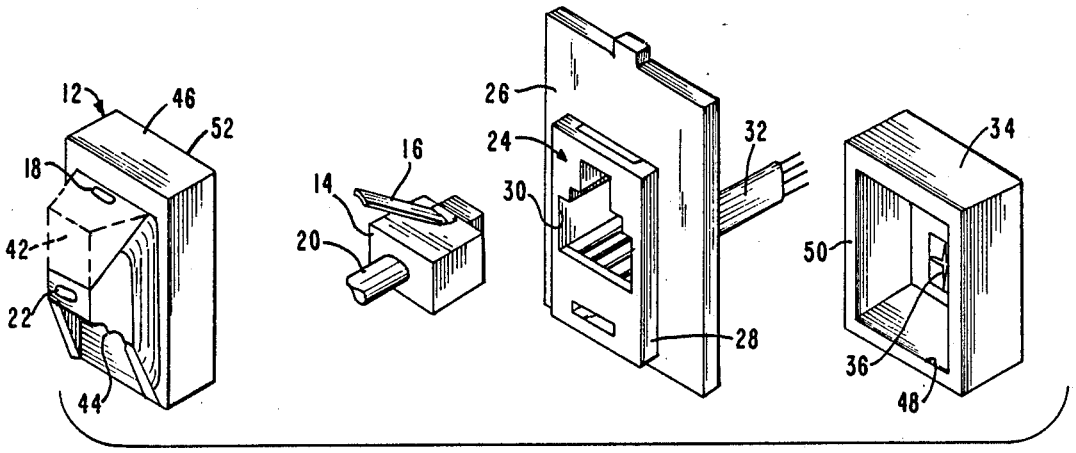
FIG. 2 is an exploded view of the assembly shown in FIG. 1.

Referring now to FIG. 2 which is an exploded view of the assembly shown in FIG. 1. The plug shroud may have a resilient encapsulant, not shown, placed about aperture 22 through which cable 20 is placed to seal the cable 20 to the shroud 12 thereby sealing off any moisture path. In a like manner aperture or opening 18 may be sealed with an encapsulant, not shown, once the locking lever 16 extends therethrough.

Alternatively, a caplet 42 which is a miniature shroud portion may be affixed to or molded internal with shroud 12 is designed to encompass the opening 18 and be sealed to and form an integral part of the shroud 12 so that locking lever 18 is completely enclosed within the caplet and shroud combination. The resiliency of caplet 42 permits the free movement of the locking lever 16 so that the plug 12 may be readily inserted and removed from the jack 24. Additionally a finger gripping portion 44 may be provided on the underside of the outwardly extending portion of shroud 12 to make it easy for an individual to remove the plug and shroud once it has been inserted into the jack opening 30. The extending lip portion 46 is selected to frictionally engage the protruding lip portion 28 provided on jack 24 so that the forceful cooperation therebetween provides an ideal moisture barrier thereby protecting the plug 14 and socket 24 from acquiring any moisture therein.

In a like manner an extending lip portion 48 provided on jack or socket shroud 34 provides for frictional engagement of the extending portion, not shown, on the rear of socket or jack 24 thereby preventing any moisture from entering the rear of socket 24.

Figure 3:
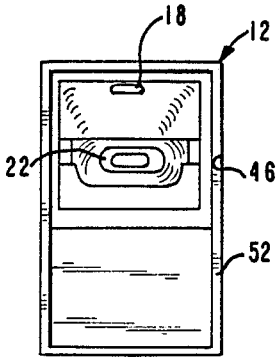
FIG. 3 is a front view of the resilient plug shroud.
Figure 5:
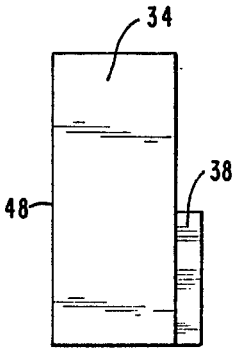
FIG. 5 is a side view in elevation of the resilient jack shroud.

FIGS. 3, 4 and 5 show alternate views of the plug shroud 12 (FIG. 3) and a rear and side view of the jack shroud 34 to more readily discern their configurations.

In operation, the jack or socket 24 is fabricated as an integral part of surface 26 in a conventional manner, which may be horizontal or vertical such that there is a protruding lip portion 28 extending above the surface upon which it is mounted and an extending portion provided on the rear of the socket 24. The cable 32 is prewired to the socket, in a conventional manner. The plug may be prewired with the cable 20 in a conventional manner. The cable 20 is fed through the opening 22 until the plug is received in the plug shroud 12 and intimate contact therewith whereupon an encapsulant may be placed over the opening 22 sealing the cable 20 to the shroud 12. In the same manner an encapsulant may be placed about the locking lever 16 so that aperture 18 is completely closed off. The plug 14 together with the shroud 12 thereon may be inserted into the opening 30 of jack 24 and the lip portion 46 of shroud 12 forced over the extending lip portion 28 so that good frictional contact is made therebetween.

In a like manner, cable 32 is fed through aperture 36 and shroud 34 is pulled up into intimate contact with socket 24 such that the lip portion 48 frictionally engages the extending portion provided on socket 24 thereby making a complete sealed unit. Shroud 34 is pulled up sufficiently to allow the surface 50 of shroud 34 to become into intimate contact with the rear of surface 26. Ideally the front surface 52 is in intimate contact with surface 26 to provide additional sealing for the plug shroud 12.

Preferably, the resilient male shroud 12 and jack shroud 34 are fabricated from a compound known as Novathane manufactured by the Novatec Plastics & Chemical Co., Inc., of Eatontown, N.J. The encapsulant may be of any well known types presently available on the market suitable of retaining its properties over the operating temperature range of the equipment.

Hereinbefore has been disclosed an inexpensive reliable means for weatherproofing a telephone connector plug and jack assembly. It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A weatherproofing apparatus for a telephone connector having a lockinq lever disposed thereon comprising:

resilient plug shroud means having;

(i) a first opening adapted to receive a telephone cable therethrough, (ii) a second opening adapted to receive said locking lever, (iii) a third opening distal to said first opening adapted to receive said telephone plug therethrough, and (iv) lip means disposed about the perimeter of said third opening for frictionally receiving a mating telephone jack.

2. A weatherproofing apparatus for a telephone connector plug according to claim 1 further including a resilient caplet, said resilient caplet being integral with said shroud encompassing said second opening and said locking lever.

3. A weatherproof apparatus for a telephone connector according to claim 1 further including:

resilient jack shroud means having;

(i) a first opening adapted to receive said telephone cable therethrough, (ii) a second opening adapted to receive a telephone jack therein, and (iii) lip means disposed about said second jack opening for frictionally engaging the circumference of said telephone jack.

4. A weatherproofing apparatus for a telephone connector plug having a locking lever disposed thereon and a mating telephone jack comprising in combination:

(a) resilient plug shroud means having;

(i) a first opening adapted to receive a telephone cable therethrough, (ii) a second opening adapted to receive said locking lever, (iii) a third opening distal to said first opening adapted to receive said telephone plug therethrough, and (iv) lip means disposed about the perimeter of said third opening adapted to frictionally receive a mating telephone jack; and (b) resilient jack shroud means having;

(i) a fourth opening adapted to receive said telephone cable therethrough, (ii) a fifth opening adapted to receive a telephone jack therein, and (iii) lip means disposed about said fifth opening for frictionally engaging the circumference of said telephone jack.

5. A weatherproofing apparatus for a telephone connector plug according to claim 4 further including a resilient caplet, said resilient caplet being integral with said shroud encompassing said second opening and said locking lever.

6. A weatherproof apparatus for a telephone connector plug according to claim 1 further including a finger grip disposed on the surface opposite said second opening.

7. A weatherproofing apparatus for a telephone connector plug according to claim 4 further including a finger grip disposed on the surface opposite said second opening.

* * * * *